US008500463B2

(12) United States Patent
Tsai et al.

(10) Patent No.: US 8,500,463 B2
(45) Date of Patent: Aug. 6, 2013

(54) USB CONNECTOR

(75) Inventors: Chia-Hsin Tsai, New Taipei (TW); Yu-Cheng Chang, New Taipei (TW)

(73) Assignee: Power Quotient International Co., Ltd., New Taipei (TW)

( * ) Notice: Subject to any disclaimer, the term of this patent is extended or adjusted under 35 U.S.C. 154(b) by 0 days.

(21) Appl. No.: 13/371,645

(22) Filed: Feb. 13, 2012

(65) Prior Publication Data

US 2012/0289089 A1 Nov. 15, 2012

(30) Foreign Application Priority Data

May 12, 2011 (TW) ..... 100208477 U

(51) Int. Cl.
*H01R 12/10* (2006.01)

(52) U.S. Cl.
USPC ..... 439/78

(58) Field of Classification Search
USPC ..... 439/78–80, 108, 660, 83–85, 733.1
See application file for complete search history.

(56) References Cited

U.S. PATENT DOCUMENTS

| | | | | |
|---|---|---|---|---|
| 7,422,488 | B1 * | 9/2008 | Wu | 439/676 |
| 7,618,293 | B2 * | 11/2009 | Wu | 439/660 |
| 7,685,337 | B2 * | 3/2010 | Merry et al. | 710/62 |
| 7,744,426 | B2 * | 6/2010 | Zheng et al. | 439/660 |
| 8,007,323 | B1 * | 8/2011 | Yao et al. | 439/660 |
| 8,062,050 | B2 * | 11/2011 | Wu | 439/350 |

* cited by examiner

*Primary Examiner* — Alexander Gilman
(74) *Attorney, Agent, or Firm* — Guice Patents PLLC

(57) ABSTRACT

The present invention relates to a USB connector, which comprises: a connector main body having plural open slots, plural first terminals and plural second terminals; and a substrate having plural first contact pads and plural second contact pads respectively exposed outside the substrate, and the plural first contact pads and the plural second contact pads are staggeringly arranged for being respectively coupled to the plural first terminals and the plural second terminals, thereby forming a USB connector. The USB connector allows a USB2.0 connector and a USB3.0 connector to be respectively inserted.

13 Claims, 3 Drawing Sheets

USB CONNECTOR

BACKGROUND OF THE INVENTION

1. Field of the Invention

The present invention relates to a USB connector, especially to a USB connector supporting both protocols of USB2.0 and USB3.0.

2. Description of Related Art

A peripheral device having USB interfaces provides a plug-and-play function, so after relevant products are launched, the products really catch consumers attention. The USB2.0 protocol is capable of providing a transmission speed up to 480 M bits/sec. With the development of multimedia technology, if a multimedia file having a volume of 25 GB is desired to be downloaded through the USB2.0 protocol, it may take quite a while and may not satisfy consumer's needs. As a result, the USB3.0 protocol is launched, the USB3.0 protocol is capable of providing a transmission speed up to 4.8 G bits/sec, if the same 25 GB multimedia file is desired to be downloaded through the USB 3.0 protocol, the required time is only one tenth of the original time that the USB2.0 protocol may take.

However, the USB2.0 protocol is still the main stream in the market, and most peripheral devices having USB interfaces can only support the USB2.0 protocol, so how to design an electric connector capable of supporting both of the USB2.0 and USB3.0 protocols is an issue to be concerned.

With respect to the mentioned disadvantages of conventional connectors, the present invention provides a novel USB connector for improving the disadvantages.

SUMMARY OF THE INVENTION

One primary objective of the present invention is to provide a USB connector having a USB2.0 connector and a USB3.0 connector having different transmission speed, for meeting the needs of transmitting with different transmission speeds.

Another objective of the present invention is to provide a USB connector having advantages of thinner thickness, lower production cost and not limiting to be applied in certain models when being used.

For achieving the objectives, the present invention provides a USB connector, which comprises: a connector main body having plural open slots, plural first terminals and plural second terminals, wherein every two open slots is spaced by a slot column, one end of the plural first terminals are respectively disposed below the plural slot columns and exposed outside the plural slot columns then forwardly extended, the other ends are respectively and downwardly bent then horizontally extended, thereby forming a solder end, one end of the plural second terminals are respectively provided in the plural open slots and exposed outside the open slots, the other ends are respectively and downwardly bent then horizontally extended, thereby forming a solder end; and a substrate having plural first contact pads and plural second contact pads, and the plural first contact pads and the plural second contact pads are staggeringly arranged for being respectively coupled to the plural first terminals and the plural second terminals, thereby forming a USB connector.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
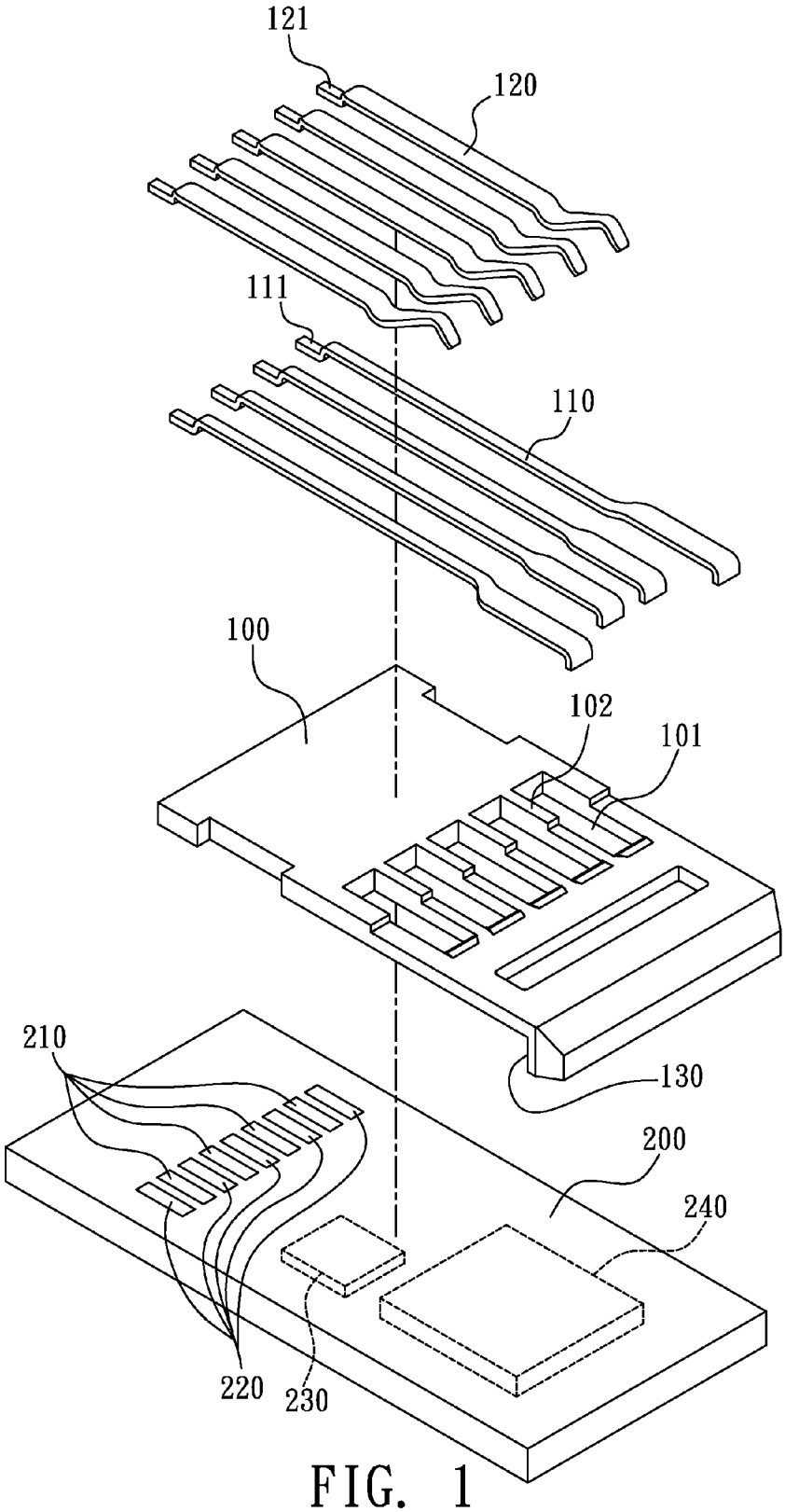
FIG. 1 is a schematic exploded view illustrating the USB connector according to one preferred embodiment of the present invention.
Figure 2:
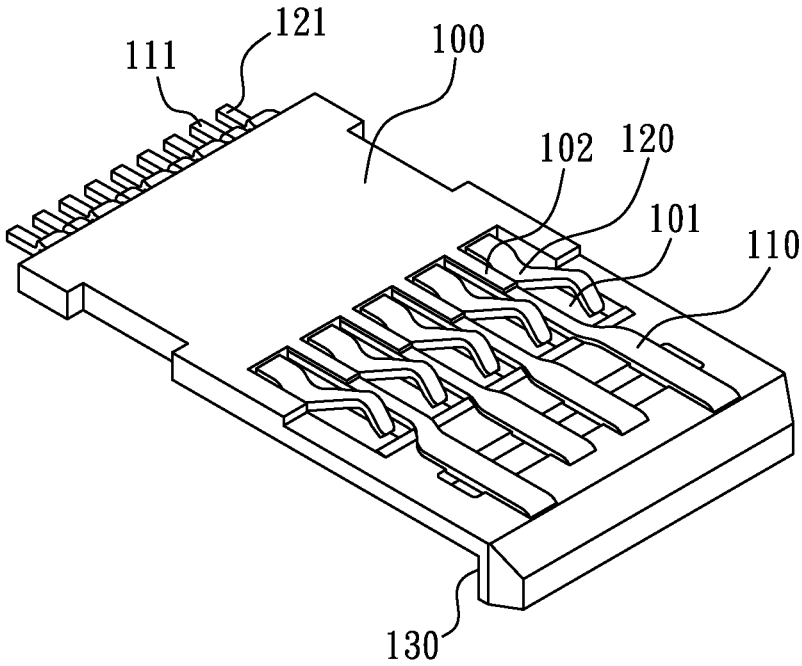
FIG. 2 is a schematic view illustrating the assembly of the connector main body according to one preferred embodiment of the present invention.
Figure 3:
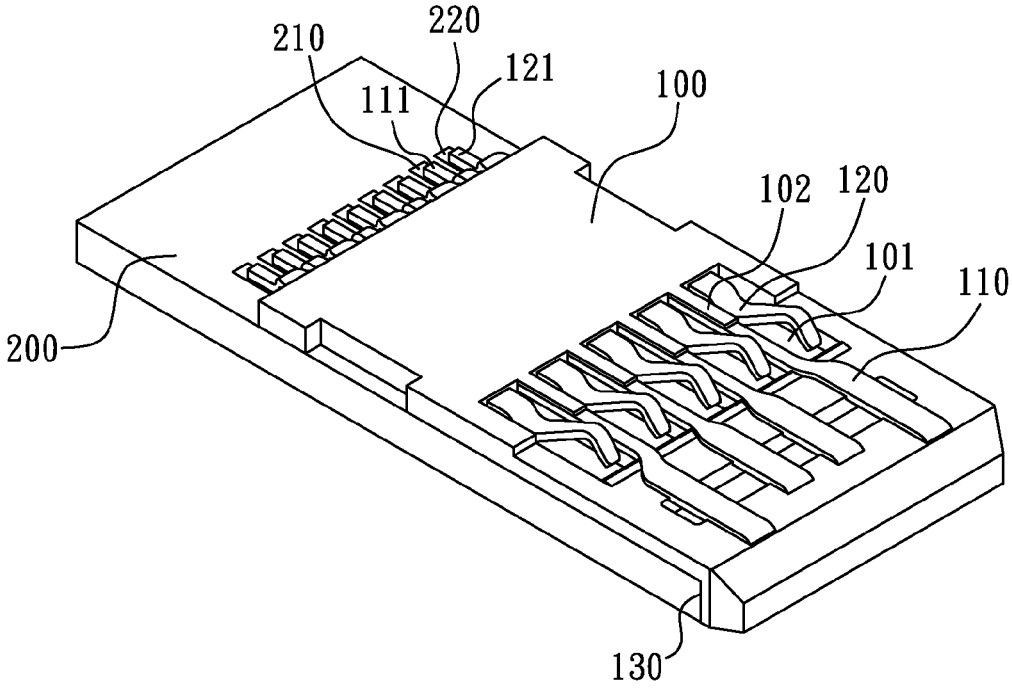
FIG. 3 is a schematic view illustrating the assembly of the USB connector according to one preferred embodiment of the present invention.

The accompanying drawings are included to provide a further understanding of the invention, and are incorporated in and constitute a part of this specification. The drawings illustrate embodiments of the invention and, together with the description, serve to explain the principles of the invention, wherein FIG. 1 is a schematic exploded view showing the USB connector according to one preferred embodiment of the present invention; FIG. 2 is a schematic view showing the assembly of the connector main body according to one preferred embodiment of the present invention; and FIG. 3 is a schematic view showing the assembly of the USB connector according to one preferred embodiment of the present invention.

As shown in figures, the USB connector provided by the present invention comprises a connector main body 100 and a substrate 200.

The connector main body 100 is made of an insulation material, e.g. but not limited to plastic, and is formed with plural open slots 101, plural first terminals 110 and plural second terminals 120, wherein every two open slots 101 is spaced through a slot column 102, one end of the plural first terminals 110, e.g. but not limited to the right end, are respectively disposed below the plural slot columns 102, exposed outside the plural slot columns 102 then forwardly extended, the other ends, e.g. but not limited to the left end, are respectively and downwardly bent then horizontally extended, thereby forming a solder end 111. Wherein, the quantity of the plural first terminals 110 is the same as that of the plural slot columns 102, and the quantity is e.g. but not limited to four.

One end of the plural second terminals 120, e.g. but not limited to the right end, are respectively provided in the plural open slots 101 and exposed outside the open slots 101, the other ends, e.g. but not limited to the left end, are respectively and downwardly bent then horizontally extended, thereby forming a solder end 121. Wherein, the quantity of the plural second terminals 120 is the same as that of the plural open slots 101, and the quantity is e.g. but not limited to five.

In addition, one end of each second terminal 120 is exposed outside the open slot 101 then further upwardly bent then downwardly bent.

The substrate 200 has plural first contact pads 210 and plural second contact pads 220 respectively exposed outside the substrate 200, and the plural first contact pads 210 and the plural second contact pads 220 are, for example, staggeringly arranged. The plural first contact pads 210 and the plural second contact pads 220 are respectively served to allow the solder ends 111 of the plural first terminals 110 and the solder ends 121 of the plural second terminals 120 to be soldered thereon.

Moreover, the substrate 200 is, e.g. but not limited to, a Chip-On-Board (COB) substrate or a printed circuit board substrate; in this embodiment, the COB substrate is adopted for illustration and not served as a limitation. The COB technology has properties of thin thickness, compact wiring and small area, so it is widely used in the package of LCD driving chips or NAND flash memories.

The quantity of the plural first contact pads 210 is e.g. but not limited to four, thereby forming a USB2.0 connector, wherein the plural first contact pads 210 are able to respectively transmit $V_{BUS}$, D−, D+ and GND signals of USB2.0 specification.

The plural second contact pads 220 are, for example, staggeringly arranged with the plural first contact pads 210, the quantity thereof is e.g. but not limited to five, wherein the plural second contact pads 220 are able to respectively transmit StdA_SSRX−, StdA_SSRX+, GND_DRAIN, StdA_SSTX− and StdA_SSTX+ signals of USB3.0 specification.

In addition, the front of the connector main body 100 is installed with a stop part 130 for stopping and positioning the substrate 200, such that the plural first contact pads 210 and the plural second contact pads 220 are able to be aligned with the solder ends 111 of the plural first terminals 110 and the solder ends 121 of the plural second terminals 120.

According to the USB connector provided by the present invention, the substrate 200 further includes a USB controller 230 and at least a flash memory 240 respectively coupled to the plural first contact pads 210 and the plural second contact pads 220. The USB controller 230 and the flash memory 240 are installed on the substrate 200 with the Chip-On-Board (COB) means, wherein the Chip-On-Board technique is a conventional art therefore no further illustration is provided.

Referring to FIG. 2 and FIG. 3, when being manufactured, firstly the plural first terminals 110 and the plural second terminals 120 are staggeringly arranged, then integrally formed with the connector main body 100 for assembling as one piece; then the connector main body 100 is disposed on the substrate 200 and one end thereof abuts against the stop part 130 for allowing the solder ends 111 of the plural first terminals 110 and the solder ends 121 of the plural second terminals 120 to be respectively aligned with the plural first contact pads 210 and the plural second contact pads 220, then respectively soldered on the plural first contact pads 210 and the plural second contact pads 220 with a Surface Mount Technology (SMT), thereby forming the USB connector of the present invention. According to the USB connector provided by the present invention, the four first terminals 110 can form a USB2.0 connector, the five second terminals 120 can form a USB3.0 connector, thereby respectively allowing a USB2.0 plug or a USB3.0 plug to be inserted. As such, the USB connector provided by the present invention has advantages of thinner thickness, lower production cost and not limiting to be applied in certain models when being used.

As what is disclosed above, the USB connector of the present invention has a USB2.0 connector and a USB3.0 connector having different transmission speed, for meeting the needs of USB connector having different transmission speed; and the USB connector of the present invention has advantages of thinner thickness and lower production cost and not limiting to be applied in certain models when being used. Therefore the USB connector provided by the present invention is novel compared to conventional USB connectors.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A USB connector, comprising:

a connector main body having a plurality of open slots, a plurality of slot columns, a plurality of first terminals and a plurality of second terminals, wherein every two corresponding open slots of the plurality of open slots being spaced by the slot column of a plurality of slot columns, each first terminal of the plurality of first terminals being respectively embedded in a corresponding slot column of the plurality of slot columns and having a first end thereof exposed outside the plurality of slot columns then extending forwardly, and a second end thereof being respectively and downwardly bent then extending horizontally forming a solder end, a first end of each second terminal of the plurality of second terminals being respectively located in a corresponding slot of the plurality of open slots and exposed outside the open slots and a second end thereof being respectively and downwardly bent then extending horizontally, thereby forming a solder end, each first terminal of the plurality of first terminals is located between two second terminals of the plurality of second terminals; and a substrate located directly below and engaging a bottom surface of the connector main body and having a plurality of first contact pads and a plurality of second contact pads located on a same surface thereof, and the plurality of first contact pads and the plurality of second contact pads being alternatingly arranged, each first contact pad of the plurality of first contact pads is located between two second contact pads of the plurality of second contact pads, the plurality of first terminals are connected to the plurality of first contact pads and the plurality of second terminals are connected to the plurality of second contact pads, thereby forming a USB connector.

2. The USB connector as claimed in claim 1, wherein said substrate is a Chip-On-Board (COB) substrate.

3. The USB connector as claimed in claim 1, wherein said connector main body has a stop part located on a front end thereof and extending downwardly from the bottom surface thereof and engaging an end of said substrate for stopping and positioning said substrate, wherein said plurality of first contact pads and said plurality of second contact pads are aligned with the solder ends of said plurality of first terminals and the solder ends of said plurality of second terminals respectively.

4. The USB connector as claimed in claim 1, wherein a quantity of said plurality of first contact pads and a quantity of said plurality of first terminals are both four for forming a USB2.0 connector; a quantity of said plurality of second contact pads, a quantity of said plurality of open slots and the quantity of said plurality of second terminals are all five for forming a USB3.0 connector.

5. The USB connector as claimed in claim 1, wherein said substrate further includes a USB controller and at least a flash memory respectively coupled to said plurality of first contact pads and said plurality of second contact pads.

6. The USB connector as claimed in claim 1, wherein the solder ends of said plurality of first terminals and the solder ends of said plurality of second terminals of said connector are respectively soldered on said plurality of first contact pads and said plurality of second contact pads with a Surface Mount Technology (SMT).

7. The USB connector as claimed in claim 1, wherein the first end of each second terminal is exposed outside said open slot then further upwardly bent then downwardly bent.

8. The USB connector as claimed in claim 1, wherein said connector main body, said plurality of open slots, and said plurality of slot columns are integrally formed as a single component.

9. The USB connector as claimed in claim 1, wherein said substrate is a printed circuit board substrate.

10. A substrate, comprising:

a plurality of first contact pads and a plurality of second contact pads located on a same surface thereof, and the plurality of first contact pads and the plurality of second contact pads being alternatingly arranged, each first contact pad of the plurality of first contact pads is located between two second contact pads of the plurality of second contact pads;

a USB controller disposed on said substrate and coupled to the plurality of first contact pads and the plurality of second contact pads; and at least a flash memory disposed on said substrate and coupled to the USB controller, the plurality of first contact pads and the plurality of second contact pads;

wherein the substrate is part of a connector with a connector main body, said connector main body having a plurality of open slots, a plurality of first terminals and a plurality of second terminals, wherein every two corresponding open slots of the plurality of open slots being spaced by the slot column of a plurality of slot columns, each first terminal of the plurality of first terminals being respectively embedded in a corresponding slot column of the plurality of slot columns and having a first end thereof exposed outside the plurality of slot columns then extending forwardly, and a second end thereof being respectively and downwardly bent then extending horizontally forming a solder end, a first end of each second terminal of the plurality of second terminals being respectively located in a corresponding slot of the plurality of open slots and exposed outside the open slots and a second end thereof being respectively and downwardly bent then extending horizontally, thereby forming a solder end, each first terminal of the plurality of first terminals is located between two second terminals of the plurality of second terminals.

11. The substrate as claimed in claim 10, wherein said substrate is a Chip-On-Board (COB) substrate.

12. The substrate as claimed in claim 10, wherein the quantity of said plurality of first contact pads is four and capable of forming a USB2.0 connector after being assembled with the connector main body; the quantity of said plurality of second contact pads is five and capable of forming a USB3.0 connector after being assembled with the connector main body.

13. The USB connector as claimed in claim 10, wherein said substrate is a printed circuit board substrate.

* * * * *